United States Patent [19]

Higashiyama et al.

[11] 4,319,327

[45] Mar. 9, 1982

[54] LOAD DEPENDENT FUEL INJECTION CONTROL SYSTEM

[75] Inventors: Kazuhiro Higashiyama, Atsugi; Akio Hosaka, Yokohama, both of Japan

[73] Assignee: Nissan Motor Company Limited, Yokohama, Japan

[21] Appl. No.: 100,570

[22] Filed: Dec. 5, 1979

[30] Foreign Application Priority Data

Dec. 6, 1978 [JP] Japan ..... 53-149931

[51] Int. Cl.[3] ..... F02D 5/02; F02M 51/00

[52] U.S. Cl. ..... 364/431.05; 123/480; 123/486; 123/492; 364/426

[58] Field of Search ..... 364/431; 123/480, 486, 123/489, 492

[56] References Cited

U.S. PATENT DOCUMENTS

| | | | |
|---|---|---|---|
| 4,140,087 | 2/1979 | Daumer et al. | 364/431 X |
| 4,143,622 | 3/1979 | Klötzner et al. | 123/492 |
| 4,199,812 | 4/1980 | Klötzner et al. | 364/431 |
| 4,200,064 | 4/1980 | Engele | 123/486 X |
| 4,201,159 | 5/1980 | Kawai et al. | 364/431 X |
| 4,201,161 | 5/1980 | Sasayama et al. | 364/431 X |
| 4,214,306 | 7/1980 | Kobayashi | 364/431 |
| 4,240,390 | 12/1980 | Takeda | 123/480 |
| 4,245,312 | 1/1981 | de Vulpillieres | 364/431 |
| 4,245,605 | 1/1981 | Rice et al. | 123/492 |
| 4,249,498 | 2/1981 | Drews et al. | 123/492 |

*Primary Examiner*—Felix D. Gruber

*Attorney, Agent, or Firm*—Schwartz, Jeffery, Schwaab, Mack, Blumenthal & Koch

[57] ABSTRACT

A fuel injection rate control system for a fuel-injection internal combustion engine, wherein basic fuel injection rate signals are produced upon detection of the load on the engine and the engine output speed and are modified by the correction values read out from a collection of data indicating various correction values in terms of the engine output speed and the engine load. When the correction values selected are zeros or smaller than a predetermined value, the fuel injection rate may be controlled to achieve a predetermined air/fuel ratio in the engine through detection of the air/fuel ratio of the mixture produced in the engine.

10 Claims, 6 Drawing Figures

ENGINE LOAD (AIR INTAKE RATE PER SINGLE CRANKESHAFT REVOLUTION) →

| | | | | | | | | | |
|---|---|---|---|---|---|---|---|---|---|
| 15 | 20 | 20 | 20 | 20 | 20 | 25 | 25 | 30 | 35 |
| 10 | 10 | 10 | 10 | 10 | 10 | 15 | 15 | 15 | 20 |
| 5 | 0 | 0 | 0 | 0 | 0 | 5 | 5 | 5 | 8 |
| 0 | 0 | 0 | 0 | 0 | 0 | 0 | 3 | 3 | 5 |
| 0 | 0 | 0 | 0 | 0 | 0 | 2 | 2 | 2 | 2 |

ENGINE OUTPUT SPEED →

LOAD DEPENDENT FUEL INJECTION CONTROL SYSTEM

FIELD OF THE INVENTION

The present invention relates in general to internal combustion engines for and particularly to an internal combustion engine of the fuel injection type. More particularly, the present invention is concerned with a fuel injection rate control system for a fuel-injection internal combustion engine for automotive use.

BACKGROUND OF THE INVENTION

As is well known in the art, it is an ordinary practice to make richer the air-fuel mixture to be combusted in an internal combustion engine than a normal or, for example, stoichiometric mixture under high-load conditions (such as full throttle or accelerating conditions) when the engine is required to produce increased power outputs.

Enrichment of the air-fuel mixture to be produced in an internal combustion engine is also required under high-speed operating conditions of the engine when the exhaust gases discharged from the engine tend to be heated excessively if the air/fuel ratio of the mixture to be combusted in the engine is maintained at the stoichiometric value.

In a conventional fuel-injection internal combustion engine, the fuel injection valve of the engine is therefore controlled to achieve an increased fuel injection amount under high-load or high-speed operating conditions of the engine. The adjustment of the fuel injection amount in this internal combustion engine is effected in such a manner that the fuel injection amount is increased by a predetermined value when the output speed of the engine, the intake air flow rate in the air induction pipe of the engine, or the opening degree of the throttle valve provided in the induction pipe of the engine is increased beyond a predetermined value.

In the fuel injection amount control system of this nature, however, a problem is encountered in that the fuel injection amount cannot be adjusted satisfactorily for all the operating conditions of the engine. This is partly because of the fact that the fuel injection amount is adjusted by a fixed value and partly because of the limited degree of freedom allowed of determining the boundary between the conditions in which the adjustment is to be effected and the conditions in which the adjustment is not to be effected.

In fuel-injection internal combustion engines, especially those for automotive use, the operating conditions of the engines are liable to variation over a broad range and to sudden changes and, for this reason, proper control of the fuel injection amount is more necessary than in internal combustion engines for other applications. For enhancement of the exhaust emission control efficiency, the driveability and the fuel economy in a fuel-injection internal combustion engine, furthermore, it is required that the fuel injection amount should be controlled more precisely than those controlled by existing fuel injection rate control systems.

The present invention contemplates resolution of these problems encountered in prior-art fuel injection control systems for fuel-injection internal combustion engines and, accordingly, it is an object of the present invention to provide a fuel injection control system capable of controlling the fuel injection amount in a fuel-injection combustion engine properly and precisely for various operating conditions of the engine by the aid of an electronic control circuit such as a microcomputer.

SUMMARY OF THE INVENTION

In accordance with the present invention, such an object is accomplished basically in a fuel injection control system comprising engine load detecting means for detecting the load on a fuel-injection internal combustion engine and producting an output signal representative of the detected engine load, engine speed detecting means for detecting the output speed of the engine and producing an output signal representative of the detected engine output speed, digital processing means electrically coupled between a fuel injection valve and the engine load and engine speed detecting means and programmed to produce fuel injection amount control signals representative of predetermined basic fuel amounts variable with the output signals delivered from the engine load and engine speed detecting means, and memory means having stored therein a collection of data representative of predetermined correction values in terms of engine output speed and engine load, the digital processing means being further programmed to modify the above mentioned fuel injection rate control signals and thereby adjust the above mentioned basic fuel injection amounts on the basis of the aforesaid correction values.

If desired, the fuel injection control system according to the present invention may further comprise air-fuel ratio detecting means for detecting the air/fuel ratio of the air/fuel mixture produced in the engine and producing an output signal representative of the detected air/fuel ratio. In this instance, the digital processing means of the control system is further programmed in such a manner as to be responsive to the output signal from air-fuel ratio detecting means for delivering to the fuel injection valve a signal effective to achieve a predetermined fuel injection amount when the correction values represented by the data stored in the memory means are within a predetermined range.

FURTHER DESCRIPTION OF THE PRIOR ART

Figure 1:
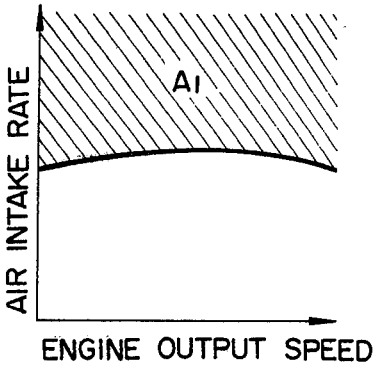
FIG. 1 is a graph showing an example of the air intake rate-engine output speed characteristic of a fuel-injection internal combustion engine in which the fuel injection amount is controlled on the basis of the opening degree of the throttle valve provided in the air intake assembly of the engine.
Figure 2:
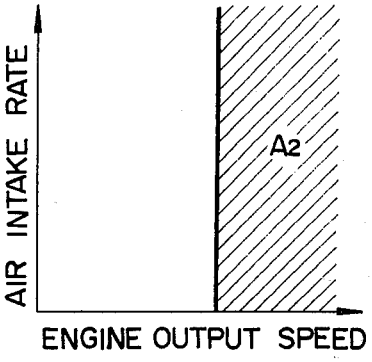
FIG. 2 is a graph similar to that of FIG. 1 but shows an example of the air intake rate-engine output speed characteristic of a fuel-injection internal combustion engine in which the fuel injection amount is controlled on the basis of the output speed of the engine.
Figure 3:
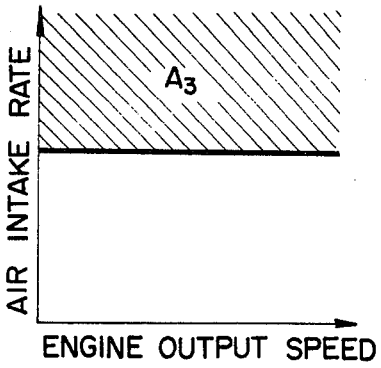
FIG. 3 is a graph also similar to that of FIG. 1 but shows an example of the air intake rate-engine output speed characteristics of a fuel-injection internal combustion engine in which the fuel injection amount is controlled on the basis of the induction rate of air in the air intake assembly of the engine.

As discussed previously, the fuel injection rate in a conventional fuel-injection internal combustion engine is controlled in such a manner that the basic fuel injection amount is increased by a predetermined value under predetermined conditions. The predetermined conditions may be the full throttle conditions of the engine higher than a predetermined value as indicated by the hatched area $A_1$ in the graph of FIG. 1 or may be the conditions in which the output speed of the engine is higher than a predetermined value as indicated by the hatched area $A_2$ in the graph of FIG. 2. As an alternative, the predetermined conditions may be the conditions in which the air induction rate per single revolution speed of the engine output shaft is higher than a predetermined value as indicated by the hatched area $A_3$ in the graph of FIG. 3. The boundary between the conditions in which the fuel injection rate is to be adjusted and the conditions in which the adjustment is not to be effected is thus determined on the basis of an extremely simple criterion. Because of the limited degree of freedom allowed in determining such a boundary and further because of the fact that the fuel injection amount is adjusted by a fixed value irrespective of the operating conditions of the engine, the resultant fuel injection amount cannot be optimum for all the operating conditions of the engine. In consideration, furthermore, of the fact that the operating conditions of a fuel-injection internal combustion engine are liable to variation over a broad range and to sudden changes, it is required to control the fuel injection in a more sophisticated fashion than in fuel-injection internal combustion engines using the control systems of the above described nature. Precise control of the fuel injection amount is further conducive to improvement in the exhaust emission control efficiency, the driveability and the fuel economy of a fuel-injection internal combustion engine as previously noted.

DESCRIPTION OF THE PREFERRED EMBODIMENT

Figures 4, 5:
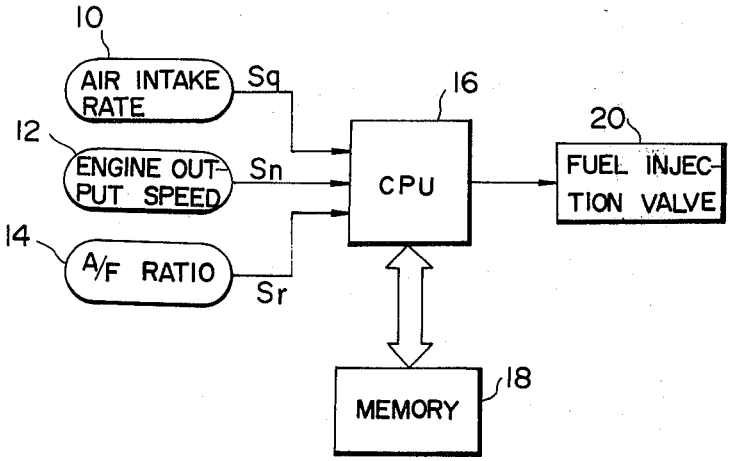
FIG. 4 is a block diagram showing a preferred embodiment of the fuel-injection control system according to the present invention.
FIG. 5 is a table showing a set of table data indicating desired fuel-injection correction values in terms of engine output speed and air induction rate.

Referring to FIG. 4, a fuel injection control system embodying the present invention comprises intake air flow rate detecting means 10 for detecting the intake air flow rate in an air induction passage on a fuel-injection internal combustion engine (not shown) and producing a digital signal Sq representative of the detected intake air flow rate, and engine speed detecting means 12 for detecting the output speed of the engine and producing a digital signal Sn representative of the detected output speed of the engine. The embodiment illustrated in FIG. 4 further comprises air/fuel ratio detecting means 14 adapted to detect the air/fuel ratio of the air-fuel mixture produced in the engine and to produce a digital signal Sr representative of the detected air/fuel ratio. The intake air flow rate detecting means 10 is adapted to detect the intake air flow rate through the air intake assembly (not shown) of the engine so that the digital signal Sq is representative of the detected intake air flow rate (Q) of air through the air intake assembly. The engine speed detecting means 12 may be constituted by an electromagnetic pickup counter adapted to produce as the output signal Sn thereof a train of pulses with a frequency proportional to the revolution speed (N) of the output shaft such as the crankshaft of the engine. On the other hand, the air/fuel ratio detecting means 14 may be of the type adapted to detect the concentration of a preselected chemical component such as oxygen in the exhaust gases discharged from the power cylinders of the engine and to monitor from the detected concentration the air/fuel ratio (R) of the mixture which has resulted in the exhaust gases sensed by the detecting means 14. Since each of the detecting means 10, 12 and 14 of the above described nature is, per se, well known to those familiar with the art, description will not be herein made in regard to the detailed construction and arrangement thereof.

The digital signals Sq, Sn and Sr thus produced by the detecting means 10, 12 and 14 are fed to digital processing means such as a central processing unit 16 (CPU) of a microcomputer which further comprises a memory unit 18. The central processing unit 16 is electrically coupled between a fuel injection valve 20 of the engine and the above described detecting means 10, 12 and 14. The central processing unit 16 determines in a known manner basic fuel injection amounts Tp which are variable with the digital signals Sq and Sn supplied from the intake air flow rate and engine speed detecting means 10 and 12, respectively. More specifically, the central processing unit 16 is operative to calculate the intake air flow rate Q per single revolution of the output shaft of the engine on the basis of the signals Sq and Sn and determine the basic fuel injection amount Tp as a function of the value Q/N. The memory unit 18 has stored therein a collection of data representative of predetermined correction values in terms of engine loads and engine speeds as shown in FIG. 5. The central processing unit 16 reads out the table data thus stored in the memory unit 18 and modifies the basic fuel injection signals on the basis of the correction values tabulated in the memory unit 18. If desired, the basic fuel injection signals may be further modified on the basis of other parameters variable with or influencing the operating conditions of the engine such as the temperature in the engine or the atmospheric pressure. Fuel injection control signals Sc thus produced by modifying the basic fuel injection signals are fed through a suitable driver circuit (not shown) to the fuel injection valve 20.

FIG. 5 shows an example of the collection of correction values stored in the memory unit 18. As shown in FIG. 5, the correction values are determined by the combinations of the engine output speeds N taken on the axis of abscissa and the engine loads (which is the air induction rates Q per single revolution of the engine output shaft) taken on the axis of ordinate and range from zeros. The central processing unit 16 reads out of correction values as the functions of the values N and Q/N represented by the signals Sn and Sq supplied from the detecting means 10 and 12, respectively, and adjusts the basic fuel injection amounts depending upon the correction values thus determined. In this fashion, the amounts of adjustment of the basic fuel injection determined by the central processing unit 16 and the boundary between the conditions in which the adjustment is to be effected and not effected can be predetermined precisely throughout the various operational conditions of the engine, particularly under high-load or high-speed conditions of the engine.

As apparent from FIG. 5, the correction values stored in the memory unit 18 covers all the engine operating conditions. The correction values are varied corresponding to engine operating conditions based on the engine load which depends on the detected intake air flow rate Q and the detected engine speed N. In the range, defined by the engine load and the engine speed, where the engine operates in a stable condition, the correction values set in the memory 18 are zero value. When in a substantially unstable condition, the correction values are set to more than zero for enrichment of the air/fuel mixture in the intake manifold.

When the correction values read out by the memory unit 18 are zeros or smaller than a predetermined value, the central processing unit 16 is responsive to the output signals Sr from the air/fuel ratio detecting means 14 and delivers to the fuel injection valve 20 a control signal representative of a predetermined air/fuel ratio such as, for example, a stoichiometric air/fuel ratio. Thus, the fuel injection valve 20 is controlled to produce in the engine an air/fuel mixture proportioned to such a predetermined air/fuel ratio when adjustment of the basic fuel injection amount determined by the central processing unit 16 is not effected or the amount of adjustment is smaller than the above mentioned predetermined value.

Figure 6:
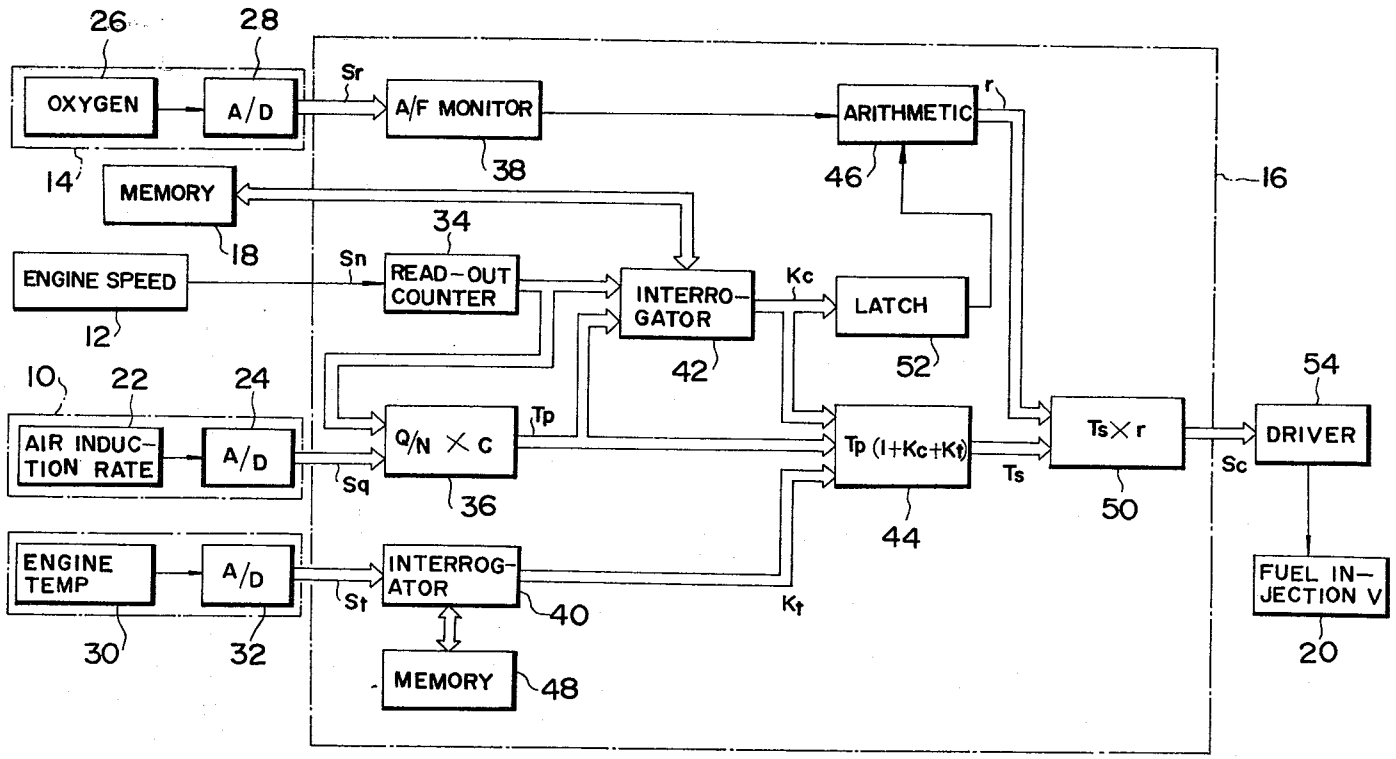
FIG. 6 is a block diagram showing a preferred example of the circuit arrangement constituting the embodiment illustrated in FIG. 4.

FIG. 6 shows a preferred example of the practical circuit arrangement of the central processing unit 16 to achieve the above described functions.

In the circuit arrangement shown in FIG. 6, the air induction rate detecting means 10 is shown consisting of an air flow meter 22 and an analog-to-digital converter 24 and, likewise, the air/fuel ratio detecting means 14 is shown consisting of an oxygen sensor 26 and an analog-to-digital converter 28. The air flow meter 22 is provided in the air intake assembly of a fuel-injection internal combustion engine (not shown) and includes a potentiometer adapted to produce an analog signal, viz, a voltage continuously variable with the flow rate of air through the air intake assembly. The analog output signal or voltage thus produced by the air flow meter 22 is fed to the analog-to-digital converter 24 and is thereby converted into corresponding digital signals Sq such as a train of pulses corresponding in, for example, frequency to the analog input signal. On the other hand, the oxygen sensor 26 forming part of the air/fuel ratio detecting means 14 is provided in the exhaust system of the engine and is operative to produce an analog output signal or a voltage which is continuously variable with the concentration of oxygen contained in the exhaust gases passed through the exhaust system. The analog output signal thus delivered from the oxygen sensor 26 is fed to the analog-to-digital converted 28 and is thereby converted into corresponding digital signals Sr such as a train of pulses corresponding in, for example, frequency to the analog output signal supplied from the sensor 26. The engine output detecting means 12 is assumed to consist of an engine speed sensor constituted by an electromagnetic pickup counter of the nature previously described and is, thus, operative to directly produce the digital signals Sn proportional in frequency to the revolution speed of the output shaft of the engine.

In the arrangement illustrated in FIG. 6, there is further provided engine temperature detecting means which is shown consisting of a temperature sensor 30 and an analog-to-digital converter 32. The temperature sensor 30 is located in, for example, the cooling water jacket (not shown) of the engine and is operative to produce an analog output signal or a voltage continuously variable with the temperature T of the cooling water being circulated through the water jacket of the engine. The analog output signal thus delivered from the temperature sensor 30 is fed to the analog-to-digital converter 32 and is thereby converted into corresponding digital signals St such as a train of pulses corresponding in, for example, frequency to the analog output signal supplied from the temperature sensor 30.

The central processing unit 16 supplied with the digital signals Sq, Sn, Sr and St thus produced comprises a signal read-out counter 34, an arithmetic unit 36, an air/fuel ratio monitor circuit 38, and an interrogator circuit 40. The signal read-out counter 34 is connected to the output terminal of the engine speed sensor 12 and is operative to count the digital signals Sn or pulses delivered from the engine speed sensor 12 and determine the engine output speed N represented by the signals Sn. The output signals produced by the read-out counter 34 are fed to an interrogator circuit 42. The arithmetic unit 36 is responsive to the output signals Sq from the analog-to-digital converter 24 and the output signals from the above described signal read-out counter 34 and is operative to produce an output signal representative of a parameter Tp which is variable with the air induction rate Q per single turn of the engine shaft and which is thus expressed as $Q/N \times C$ where c is a certain constant. The output signal produced by the arithmetic unit 36 corresponds to the previously mentioned basic fuel injection signal and, in turn, to be engine load, and is fed to the above mentioned interrogator circuit 42 and further to an arithmetic circuit 44.

On the other hand, the air/fuel ratio monitor circuit 38 is connected to the output terminal of the analog-to-digital converter 28 connected to the oxygen sensor 26 and is operative to determine the air/fuel ratio of the mixture which has resulted in the exhaust gases containing oxygen the concentration of which is represented by the signals Sr supplied from the analog-to-digital converter 28. The air/fuel ratio monitor circuit 38 thus produces a signal representative of the air/fuel ratio of the mixture monitored from the concentration of oxygen represented by the digital signals Sr supplied from the analog-to-digital converter 28. The output signal from the air/fuel ratio monitor circuit 38 is fed to an arithmetic circuit 46.

The interrogator circuit 40 is connected to the output terminal of the analog-to-digital converter 32 connected to the temperature sensor 30 and is adapted to read out a collection of data stored in a memory unit 48. The data stored in the memory unit 48 are indicative of adjustment values to be used as criteria for adjusting the basic fuel injection amount represented by the output signal from the above described arithmetic unit 36. Thus, the interrogator circuit 40 is operative to determine the adjustment values Kt to modify the output signals from the arithmetic unit 36 depending upon the engine temperatures represented by the digital signals St delivered from the analog-to-digital converter 32. The signals indicative of the adjustment values determined by the interrogator circuit 40 are fed to the arithmetic circuit 44.

The interrogator circuit 42 is responsive to the output signals from the above described signal read-out counter 34 and arithmetic unit 36 and is adapted to read out the data stored in the previously described memory unit 18 having stored therein the correction of values to be used for modifying the above mentioned basic fuel injection amount on the basis of the engine output speeds represented by the signals from the read-out counter 34 and the engine load represented by the signals supplied from the arithmetic unit 36. As shown in FIG. 5, the correction values stored in the memory unit 18 covers all the engine operating condition and is read out based on the engine speed and the engine load. The interrogator circuit 42 is thus operative to determine the correction values Kc to modify the output signals from the arithmetic unit 36 depending upon the engine output speeds N represented by the signals from the signal read-out counter 34 and the values Tp represented by the signals from the arithmetic unit 36.

The arithmetic unit 44 is, thus, responsive to the output signals respectively supplied from the arithmetic unit 36 and the interrogator circuits 40 and 42 and is operative to modify the output signal from the arithmetic unit 36 by the signals respectively delivered from the interrogator circuits 40 and 42. More specifically, the arithmetic unit 44 is adapted to produce an output signal representative of a numerical value expressed as $Tp \times (1 + Kc + Kt)$ $(= Ts)$ and delivers the signal to an arithmetic unit 50.

The signals delivered from the interrogator circuit 42 are fed not only to the arithmetic unit 44 but to a latch circuit 42 adapted to latch or disable the arithmetic unit 46 connected to the air/fuel ratio monitor circuit 38 when the correction values determined by the interrogator circuit 42 are not zeros or larger than a predetermined value. When the arithmetic unit 46 is allowed to remain operative, the arithmetic unit 46 produces an output signal representative of a parameter r variable with the air/fuel ratio determined by the air/fuel ratio monitor circuit 38. The signals thus produced by the arithmetic circuit 46 are fed to the above mentioned arithmetic unit 50.

The arithmetic unit 50 is, thus, responsive to both of the signals supplied from the arithmetic unit 44 and the signals supplied from the arithmetic unit 46 when the correction values determined by the interrogator circuit 42 are zeros are smaller than the above mentioned predetermined value and to only the signals supplied from the arithmetic unit 44 when the correction values determined by the interrogator circuit 42 are not zeros or larger than the predetermined value. When the arithmetic unit 50 is responsive to the signals supplied from the arithmetic units 44 and 46, the arithmetic unit 48 produces an output signal representative of the product of the numerical value Ts represented by the signal from the arithmetic unit 44 and the parameter r represented by the signal from the arithmetic unit 46. When the arithmetic unit 50 is supplied with the signals only from the arithmetic unit 44 in the absence of the signals from the arithmetic unit 46, the arithmetic unit 50 is operative to pass therethrough the signals from the arithmetic unit 44 without modifying the signals. The arithmetic unit 46 is programmed so that the parameter r represented by the signal to be supplied therefrom is such that the resultant value $Ts \times r$ is effective to achieve a predetermined air/fuel ratio such as a stoichiometric air/fuel ratio by the fuel supplied from the fuel injection valve.

The output signals produced by the arithmetic unit 50 in the above described manner correspond to the previously mentioned control signals Sc to be delivered from the central processing unit 16. The signals produced by the arithmetic unit 50 are thus converted into driving signals by means of a suitable driver circuit 54 and the resultant digital signals are fed to the fuel injection valve 20.

It has been described that the loads on the engine are represented by the air induction rates per single turn of the engine output shaft but it will be apparent that not only the air induction rates per single turn of the engine output shaft but other parameters such as, for example, the air induction rates per unit time, the vacuum to be developed in the intake manifold of the engine and the opening degree of the throttle valve provided in the air intake assembly of the engine can represent the load upon an engine.

What we claim is:

1. A fuel injection amount control system for a fuel injection valve of an internal combustion engine, comprising:

engine load detecting means for detecting the load on the engine and producing a signal representative of said detected engine load;

engine speed detecting means for detecting the output speed of the engine and producing a signal representative of said detected engine output speed;

memory means for storing a plurality of correction values corresponding to various combinations of engine load and speed and, responsive to said detected engine load signal and said detected engine output speed signal, for providing a correction value based upon said detected engine load signal and said engine speed signal; and means, responsive to said detected engine load signal and to said correction value, for providing a corrected fuel injection signal to said fuel injection valve.

2. A fuel injection control system as set forth in claim 1, further including:

means for detecting the air/fuel ratio produced in the engine and for providing an air/fuel ratio signal; and means, enabled by said memory means correction value being within a predetermined range, for achieving a predetermined fuel injection amount in response to said air/fuel ratio signal.

3. A fuel injection control system as set forth in claim 2, in which said correction values include zeros and in which said predetermined range includes the zero correction values.

4. A fuel injection control system as set forth in claim 2, in which the correction values included in said predetermined range are smaller than a predetermined value.

5. A fuel injection control system as set forth in any one of claims 1, 2, 3 and 4, in which said engine load detecting means is operative to detect the load on the engine from at least one of the air intake rate of the engine per single revolution of the output shaft of the engine, the air intake rate of the engine per unit time, the vacuum developed in the air induction pipe of the engine, and the opening degree of the throttle valve provided in the air induction pipe.

6. A fuel injection amount control system for a fuel injection valve of an internal combustion engine, comprising:

engine load detecting means for detecting the load on the engine and producing a signal representative of said detected engine load;

engine speed detecting means for detecting the output speed of the engine and producing a signal representative of said detected engine output speed;

means for generating basic fuel injection signals and injection correction values and, responsive to said detected engine load signal and said detected engine output speed signal, said means including a correction table storing the correction values corresponding to various combinations of engine loads and output speeds, said table being read out depending on the detected engine load signal and the detected engine output speed signal for providing a fuel injection amount correction value; and means, responsive to said basic fuel injection signal and said correction value, for changing said basic fuel injection signal by an amount equal to said correction value to provide a fuel injection amount signal to said fuel injection valve.

7. A fuel injection control system for a fuel injection valve of an internal combustion engine, comprising:

engine load detecting means for detecting the load condition of the engine and producing an engine load signal indicative of said detected engine load;

engine speed detecting means detecting the engine speed and producing an engine speed signal indicative of said detected engine speed;

air/fuel ratio detecting means for detecting the air/fuel ratio in the air/fuel mixture and producing a signal representative of the detected air/fuel ratio;

means for determining basic fuel injection pulse width based on the detected engine load signal;

means for determining correction value for the determined basic fuel injection pulse width, which means includes a correction table storing predetermined correction values as function of the engine load and the engine speed, said means being responsive to said engine load signal and said engine speed signal to read out the correction value corresponding thereto, said correction table including a plurality of the predetermined correction values covering all the engine operating condition, and including a range where the correction values are set to zero;

means for effecting correction of the basic fuel injection pulse width based on the determined correction value in order to determine the corrected fuel injection pulse width for controlling the fuel injection valve operation; and means for switching the control operation between a feedback control and an open-loop control based on the engine operating condition, which means effects feedback control based on said determined air/fuel ratio to the stochiometric air/fuel ratio when the determined correction value is smaller than a predetermined value and effect open-loop control for determining the basic fuel injection pulse width based on the engine load signal and the engine speed signal and correcting the determined base fuel injection pulse width by the determined correction value when the determined correction value is larger than the predetermined value.

8. A fuel injection control system as set forth in claim 7, wherein said means for switching the control operation effects the feedback control based on the detected air/fuel ratio when the determined correction value is zero.

9. A fuel injection control system as set forth in claim 7 or 8, wherein the fuel injection pulse width is additionally corrected based on an engine temperature determined by an engine temperature detecting means.

10. A fuel injection control system as set forth in claim 7 or 8, wherein said correction values preset in said correction table are zero when the engine load and speed signals indicate the engine is in a stable operation condition.

* * * * *